US007965951B2

(12) United States Patent
Uchida

(10) Patent No.: US 7,965,951 B2
(45) Date of Patent: Jun. 21, 2011

(54) IMAGE RECORDING APPARATUS HAVING A LOWER FIXING TEMPERATURE

(75) Inventor: Takao Uchida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/330,802

(22) Filed: Dec. 9, 2008

(65) Prior Publication Data

US 2009/0087200 A1 Apr. 2, 2009

Related U.S. Application Data

(62) Division of application No. 10/365,949, filed on Feb. 13, 2003, now Pat. No. 7,480,466.

(30) Foreign Application Priority Data

Feb. 14, 2002 (JP) ..... 2002-036652

(51) Int. Cl.
*G03G 15/00* (2006.01)

(52) U.S. Cl. ..... 399/16; 399/17; 399/18; 399/19; 399/20; 399/21

(58) Field of Classification Search ..... 399/16–21, 399/149

See application file for complete search history.

(56) References Cited

U.S. PATENT DOCUMENTS

| | | | | |
|---|---|---|---|---|
| 4,247,193 | A | 1/1981 | Kaneko et al. | |
| 5,058,879 | A | 10/1991 | Dunaway | |
| 5,268,728 | A * | 12/1993 | Sugiyama et al. | 399/20 |
| 5,459,553 | A * | 10/1995 | Kim | 399/20 |
| 5,461,460 | A * | 10/1995 | Lee | 399/21 |
| 5,678,138 | A | 10/1997 | Kobayashi et al. | |
| 5,933,677 | A | 8/1999 | Lee | |
| 6,205,297 | B1 * | 3/2001 | Tachibana et al. | 399/21 |

* cited by examiner

*Primary Examiner* — Ryan D Walsh
(74) *Attorney, Agent, or Firm* — Panitch Schwarze Belisario & Nadel LLP

(57) ABSTRACT

An image recording apparatus is disclosed. The apparatus includes a print engine; a fixing unit; a medium sensor that outputs a detection signal when a recording medium passes said medium sensor; and a controller that determines from the detection signal whether an abnormal transportation of the recording medium has occurred or not, wherein when said controller determines from the detection signal during continuous printing that a following one of two consecutive pages of recording medium remains in said print engine after removing a preceding one of the two consecutive pages that has been abnormally transported, said controller controls said fixing unit to a predetermined temperature and subsequently allows the following one of the two pages to pass through said fixing unit at a first speed so that the following one of the two pages is discharged from the image recording apparatus.

4 Claims, 12 Drawing Sheets

IMAGE RECORDING APPARATUS HAVING A LOWER FIXING TEMPERATURE

CROSS-REFERENCE TO RELATED APPLICATIONS

This application is a divisional of U.S. patent application Ser. No. 10/365,949, filed Feb. 13, 2003, and the disclosure of which is incorporated herein by reference.

BACKGROUND OF THE INVENTION

1. Field of the Invention

The present invention generally relates to an image recording apparatus.

2. Description of the Related Art

A paper jam often occurs in a conventional image recording apparatus such as a color printer in which toner images of a plurality of colors are printed on a recording medium such as paper. A paper jam occurs, for example, when transport rollers slip during the transportation of print paper or when more than one page of the print paper is fed at a time so that the controller determines that a print medium having a length greater than a specified length is fed. When a paper jam occurs, the printing operation is stopped and the jammed paper is removed. Then, after the jammed paper is completely removed, the printing operation is resumed.

FIG. 15 is a flowchart, illustrating the operation of the conventional image recording apparatus.

An IN sensor is disposed near print engines and detects the recording medium when the recording medium is fed from a paper cassette into the recording apparatus. A WR sensor is disposed immediately upstream of the print engines and detects the leading edge of the recording medium fed into the recording apparatus, there by determining a write timing at which LED heads are energized. An OUT sensor detects that the recording medium is discharged from a fixing unit. When continuous printing is initiated, an engine controller reads the outputs of the IN sensor, WR sensor, and OUT sensor to determine time lengths during which the recording medium passes these sensors. Based on these time lengths, the controller determines a paper jam depending on whether the recording medium passes these sensors earlier or later than predetermined timings. If a paper jam has occurred, the engine controller causes the image recording apparatus to stop.

Upon signals generated from a timer, not shown, the engine controller reads the outputs of the IN sensor, WR sensor, and OUT sensor at predetermined time intervals. If the ON/OFF periods of the IN sensor, WR sensor and OUT sensor are shorter than predetermined time lengths, the printing operation is terminated. If any one of the ON/OFF periods of the IN sensor, WR sensor and OUT sensor is longer than a predetermined time length, the printing operation is stopped and the occurrence of a jam is displayed.

The flowchart in FIG. 15 will be described.

At step S1, a check is made to determine whether the output wave form of the IN sensor is normal. If the waveform is normal, the program proceeds to step S2; if the wave form is not normal, then the program proceeds to step S4. At step S2, a check is made to determine whether the output waveform of the WR sensor is normal. If the waveform is normal, the program proceeds to step S3; if the waveform is not normal, then the program proceeds to step S4. At step S3, a check is made to determine whether the output waveform of the OUT sensor is normal. If the waveform of the OUT sensor is normal, the program ends; if the waveform is not normal, then the program proceeds to step S4. At step S4, the printing operation is terminated. At step S5, the occurrence of a paper jam is displayed on a display.

As described above, when a paper jam occurs, the operation of the image recording apparatus is promptly stopped, and the jammed recording medium is removed, thereby recovering from the paper jam.

With the aforementioned conventional image recording apparatus, the transport path of the recording medium from the paper cassette to a stacker is long. Therefore, when a paper jam occurs in the middle of a printing operation, it is difficult to take out the recording medium from the apparatus.

If a paper jam occurs near the entrance or exit of the print engines where paper can be seen, the jammed paper can be taken out without difficulty. If a paper jam occurs under the developing units for black, yellow, magenta, and cyan, the recording medium cannot be seen when an upper cover is opened. Therefore, the developing units for black, yellow, magenta, and cyan have to be disassembled before taking out the jammed recording medium.

The toner deposited on the jammed recording medium has not been fused yet and therefore the toner is likely to spill from the recording medium, making it difficult to handle the jammed recording medium. Moreover, care should be taken when the developing units are replaced to their original positions. If they are misplaced, a normal image cannot be obtained.

If the jammed recording paper fails to be removed from under the developing units, the sensors of the image recording apparatus cannot detect the presence of the recording medium properly. As a result, when the respective motors are driven in rotation perform a jam-handling operation, the recording medium left under the print engines is introduced into a cold fixing unit 20 and wraps around the roller in the fixing unit, so that the paper cannot be discharged normally.

SUMMARY OF THE INVENTION

The present invention was made in order to solve aforementioned drawbacks.

An object of the invention is to provide an image recording apparatus wherein when a paper jam occurs in the middle of a continuous printing operation, a printing operation is continued for a page that has entered the print engines before the occurrence of a paper jam.

Another object of the invention is to provide an image recording apparatus wherein when a paper jam occurs in the middle of a continuous printing operation, toner is removed from a page that has entered the print engines before the occurrence of the paper jam.

Still another object of the invention is to provide an image recording apparatus where a jam handling operation can be performed in a short time and reliably completed, thereby preventing the surroundings from being contaminated by the non-fused toners.

An image recording apparatus includes a print engine, a medium sensor, and a controller. The print engine prints an image on a recording medium. The medium sensor is disposed at an entrance of the print engine and outputs a detection signal when a print medium such as paper passes by the medium sensor. The controller that determines from the detection signal whether an abnormal transportation (e.g., paper jam) of the recording medium has occurred at the entrance of the print engine or not. When the abnormal transportation of a following one of two consecutive pages of the recording medium has occurred at the entrance, the controller completes a printing operation of a preceding one of the two consecutive pages and indicates the abnormal transportation of the following one of the two consecutive pages.

If the preceding one of two consecutive pages has been fed into the print engine when the abnormal transportation occurs, the controller does not perform a printing operation of the preceding one of the two consecutive pages and indicates the abnormal transportation to an operator.

When the controller determines that a trailing end of a preceding page of two consecutive pages has not passed the medium detector, the controller does not perform a printing operation of the preceding page and indicates an abnormal transportation of the preceding page to an operator.

The image recording apparatus further includes a transporting member such as a belt that transports the recording medium. The print engine is one of a plurality of print engines aligned along the transporting member in a direction in which the transporting member runs with the recording medium placed thereon.

The image recording apparatus may further include a display that displays an operating condition of the image recording apparatus. The controller causes the display to indicate an abnormal transportation of the recording medium.

The abnormal transportation of the recording medium occurs before the print medium is fed into the print engine.

An image recording apparatus includes a print engine, a fixing unit, a medium sensor and a controller. The print engine prints an image on a recording medium. The fixing unit that fixes a toner image transferred onto the recording medium by the print engine. The medium sensor outputs a detection signal when a print medium passes by the medium sensor. The controller determines from the detection signal whether an abnormal transportation of the recording medium has occurred at the entrance of the print engine or not. If a page of recording medium remains in the print engine after a jammed page has been removed, the controller controls the fixing unit to a predetermined temperature. Subsequently, the controller allows the recording medium that remains in the print engine to pass through the fixing unit at a first speed so that the recording medium is discharged from the image recording apparatus.

The predetermined temperature is a first fixing temperature for a normal printing operation.

The predetermined temperature is a second fixing temperature lower than the fixing temperature, wherein the recording medium is transferred at a second speed lower than the first speed.

The image recording apparatus further comprising a medium transporting member that transports the recording medium placed thereon. The print engine is one of a plurality of print engines aligned along the medium transporting member a direction in which the medium transporting member runs with the recording medium placed thereon.

An image recording apparatus includes a print engine, a medium detector, and a controller. The print engine prints an image on a recording medium such as paper. The medium detector that outputs a detection signal when the recording medium passes the medium detector. The controller determines from the detection signal that an abnormal transportation of the recording medium has occurred. When the medium detector outputs the detection signal, the controller causes the print engine to stop and subsequently discharges the recording medium from the image recording apparatus.

The print engine is one of a plurality of print engines. When the controller determines from the detection signal that an abnormal transportation of the recording medium has occurred, the controller causes one of the plurality of print engines to stop and discharges the recording medium.

The controller causes one of the plurality of print engines to stop, the one of the plurality of print engines being a print engine located most downstream of the plurality of print engines.

The controller causes the one of the plurality of print engines to top after the recording medium has been fed into the one of the plurality of print engines.

The image recording apparatus further includes a transfer member that transfers the toner image onto the recording medium. When the controller detects a current flowing through the transfer member such as a transfer roller and the recording medium, the controller determines that the recording medium has been fed to the transfer member.

The image recording apparatus may further include a transfer member such as a transfer roller that transfers the toner image onto the recording medium. When the controller detects a current flowing through the transfer member and the recording medium, the controller determines that the recording medium has been fed to the transfer member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings. A printer according to the present invention is of the same construction throughout the embodiments.

First Embodiment

{Construction}

Figure 1:
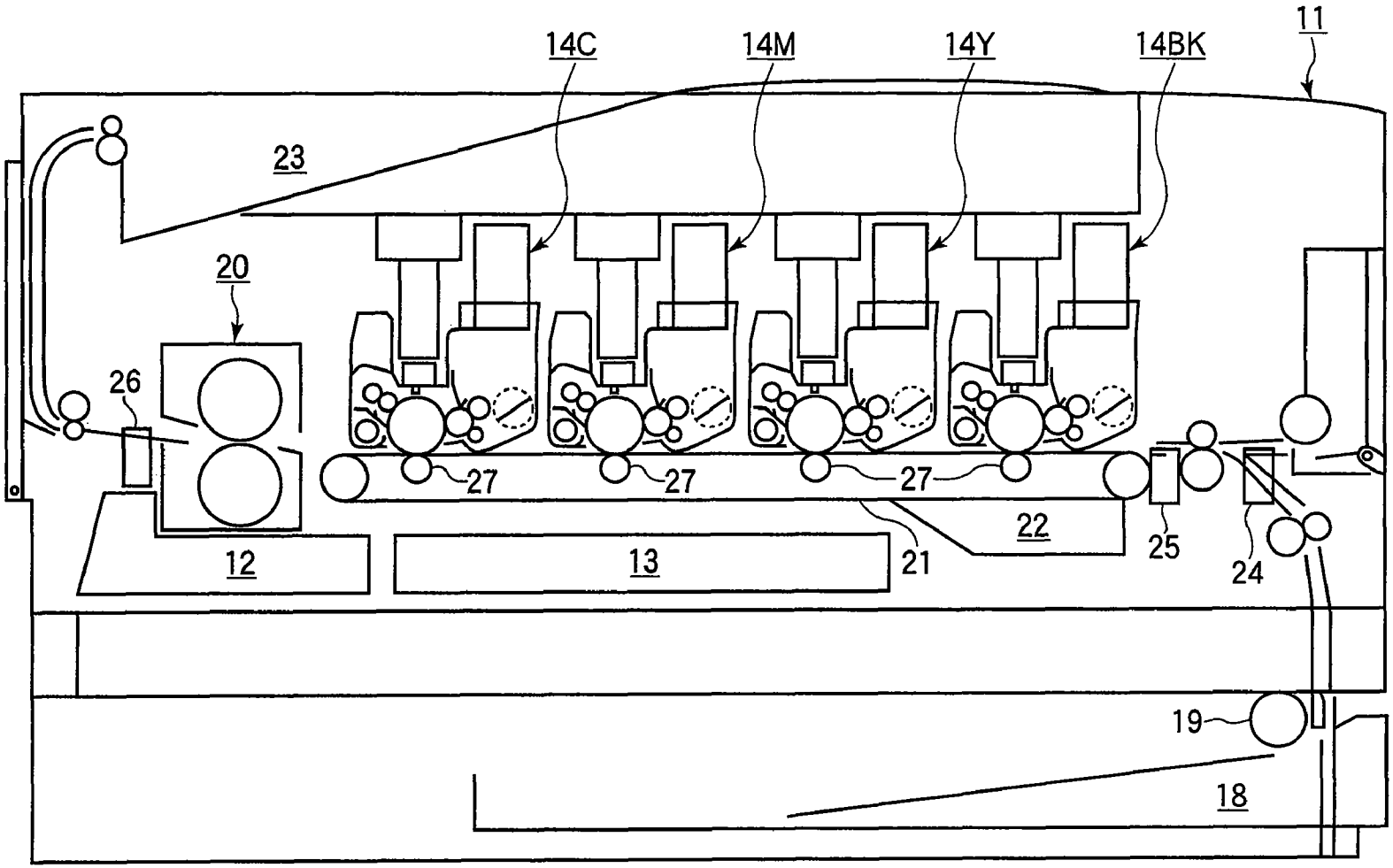
FIG. 1 is a schematic view of an image recording apparatus according to a first embodiment.

FIG. 1 is a schematic view of an image recording apparatus according to the present invention.

Figure 2:
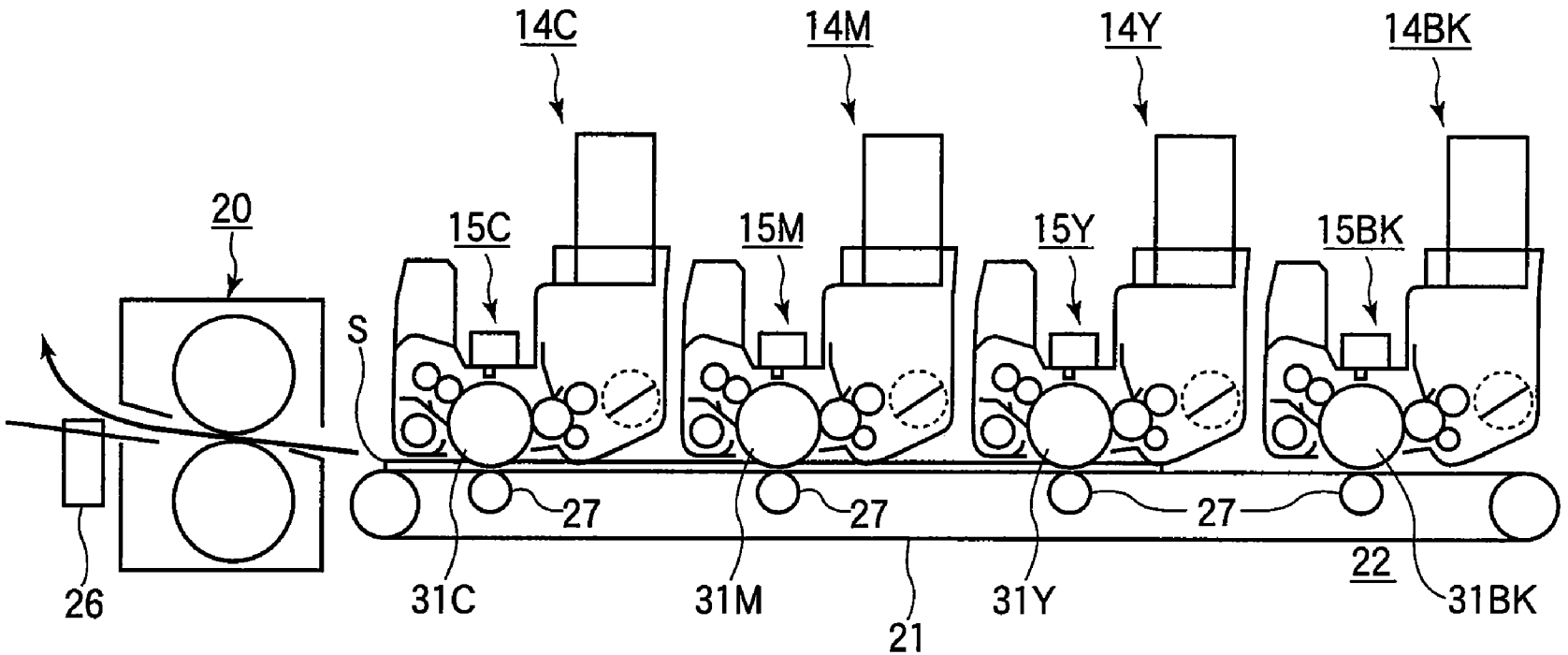
FIG. 2 is a schematic view, illustrating print engines of the image recording apparatus of FIG. 1.

FIG. 2 is a schematic view, illustrating print engines of an image recording apparatus when the recording medium is advancing through the print engines.

Referring to FIGS. 1 and 2, a printer 11 is a tandem type color printer having a plurality of LED type electrophotographic print engines are arranged along a transport path of a recording medium. LED print engines 14BK, 14Y, 14M, and 14C form toner images of black, yellow, magenta, and cyan, respectively.

A paper cassette 18 holds a stack of recording medium, not shown, which is fed into the print engines by a hopping roller 19. A transfer belt 21 runs with the recording medium placed thereon through print engines for black, yellow, magenta, and cyan images so that toner images of the respective colors are transferred onto the recording medium in registration. The recording medium is then advanced to a fixing unit 20 where the toner images are fused into a full color permanent image, and is then discharged to a stacker 23.

The LED print engines 14BK, 14Y, 14M, 14C include developing units 15BK, 15Y, 15M, and 15C, LED heads 16BK, 16Y, 16M, and 16C, and developing motors 17BK, 17Y, 17M, and 17C. The print engines operate under the control of an engine controller 30 (FIG. 3).

Figure 3:
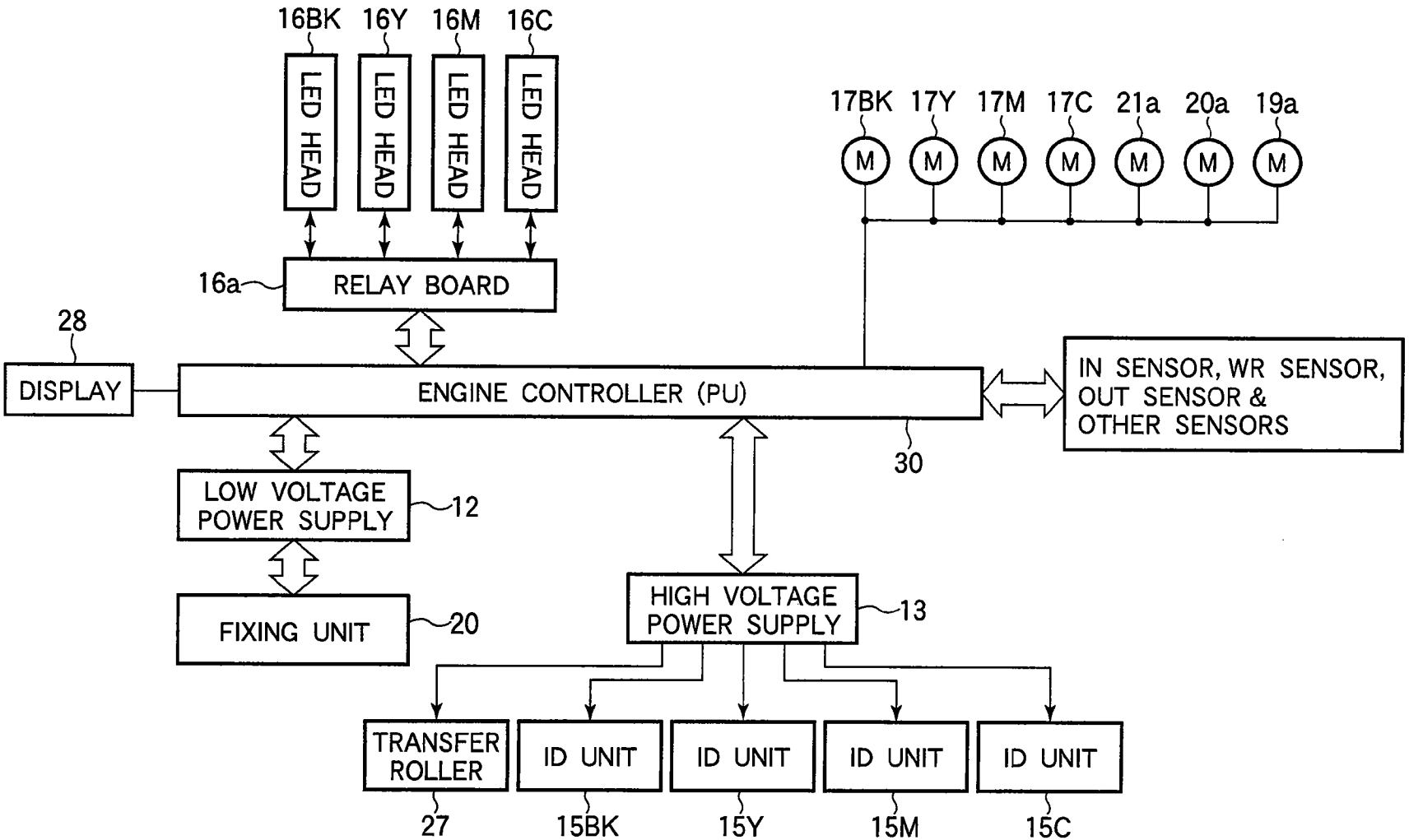
FIG. 3 is a block diagram of the image recording apparatus of FIG. 1.

FIG. 3 is a block diagram of the image recording apparatus of FIG. 1.

Referring to FIG. 3, developing units 15BK, 15Y, 15M, and 15C are connected to the engine controller 30 via a high voltage power supply 13. The LED heads 16BK, 16Y, 16M, and 16C are connected to the engine controller 30 via relay board 16*a*. The developing motors are directly connected to the engine controller 30.

The fixing unit 20 is connected to the engine controller 30 via a low voltage power supply 12 having a circuit that controls heat sources such as halogen lamps, not shown, and operates under the control of the engine controller 30. Transfer rollers 27 are connected to the engine controller 30 via a high voltage power supply 13. The engine controller 30 is also connected to a belt motor 21 a that drives the transfer belt 21 to run, a fixing motor 20*a* that drives rollers in the fixing unit 20 to rotate, and a hopping motor 19*a* that drives the hopping roller 19 in rotation.

The engine controller 30 receives the outputs of an IN sensor 24, a WR sensor 25, an OUT sensor 26, and various other sensors. The various other sensors include a paper width sensor, a paper size sensor, a paper-end sensor, an FF paper end sensor, a hopping sensor, a paper feed sensor, a heater-in sensor, a registry shock sensor, toner-low (Y/M/C/BK) sensors, a discharge sensor, a waste toner sensor, a registry up/down sensor, an EP (Y/M/C/BK) UP/down sensor, a cover open sensor, a speed sensor, a heater-temperature sensor, a backup temperature sensor, an environmental temperature sensor, and an environmental humidity sensor.

A waste toner box 22 holds waste toner therein. The IN sensor 24 detects the recording medium when it is fed into the print engines. The WR sensor 25 detects the leading edge of the recording medium fed into the print engines to determine a write timing at which the LED heads are energized. The OUT sensor 26 detects that the recording medium is discharged from the fixing unit 20. Transfer rollers 27 are arranged in the respective print engines 14BK, 14Y, 14M, and 14C.

{Operation of Sensors}

Figure 4:
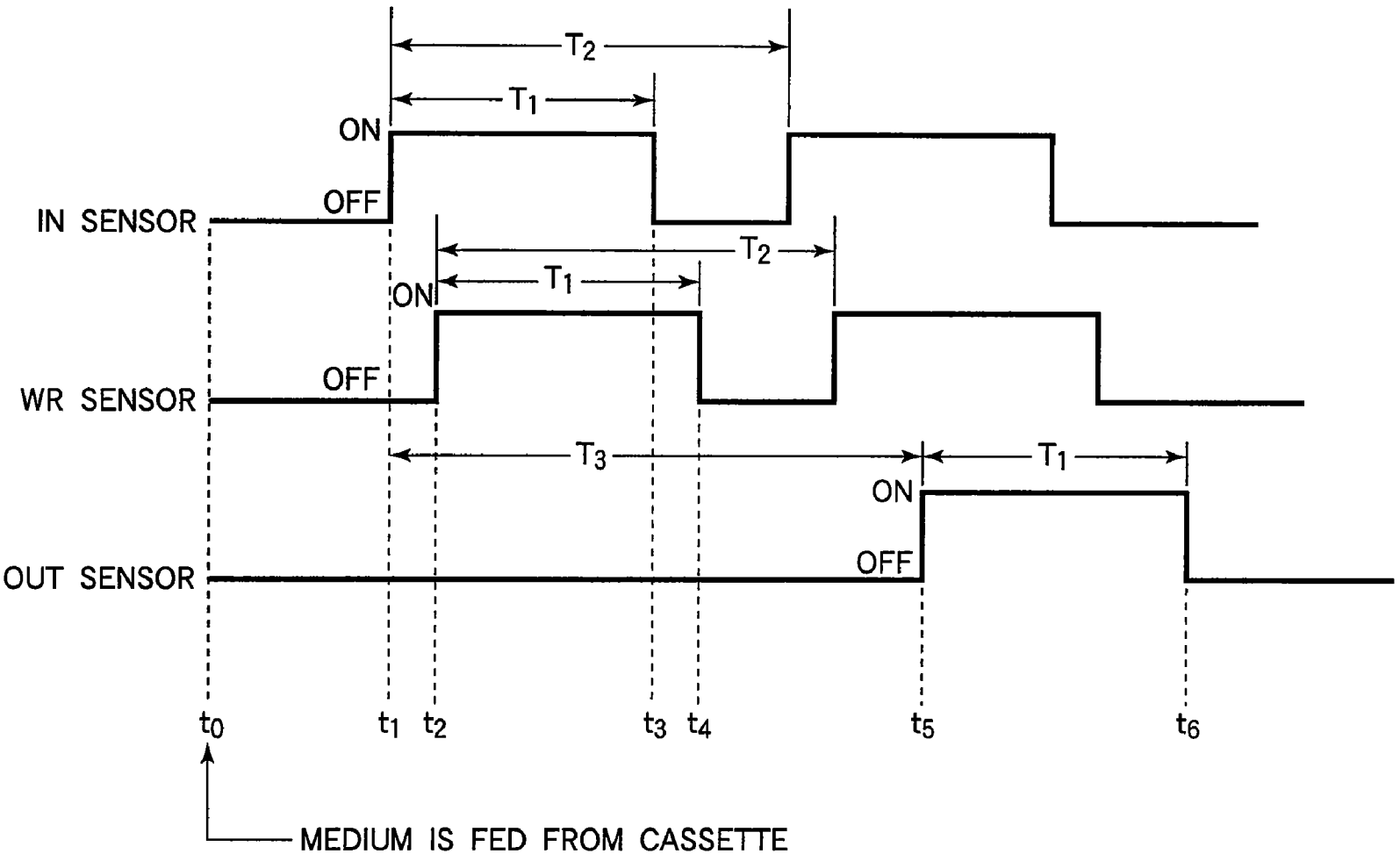
FIG. 4 is a timing chart that illustrates the waveforms of the IN sensor, WR sensor, and OUT sensor.

FIG. 4 is a timing chart that illustrates the waveforms of the IN sensor 24, WR sensor 25, and OUT sensor 26 in FIG. 1.

The operation of the aforementioned printer will be described with reference to FIG. 4.

If the IN sensor 24 does not become on between time t1 and time t1+Δt1, then it is determined that the medium is not properly transported.

If the IN sensor 24 becomes on between time t1 and time t1+Δt1, but turns off before time t3, then it is determined that the medium is shorter than a predetermined length.

If the IN sensor 24 becomes on between time t1 and time t1+Δt1, but does not turn off between time t3 and time t3+Δt2, then it is determined that the medium is not properly transported or a plurality of pages are fed in overlapped relation. Times Δt1 and Δt2 are time margins that accommodate variations of transport speed and the length of transport path.

If the WR sensor 25 does not become on between time t2 and time t2+Δt3, then it is determined that the medium is not properly transported.

If the WR sensor 25 becomes on between time t2 and time t2+Δt3, but turns off before time t4, then the medium is shorter than a predetermined length. However, it is usually determined from the output of the IN sensor 24 that the medium is shorter than a predetermined length.

If the WR sensor 25 becomes on between time t2 and time t2+Δt3, but does not turn off between time t4 and time t4+Δt4, then it is determined that the medium is not properly transported or a plurality of pages are fed in overlapped relation. Times Δt3 and Δt4 are time margins that accommodate variations of transport speed and the length of transport path.

If the OUT sensor 26 does not become on after time t5 and before time t5+Δt5, then it is determined that the medium is not properly transported.

If the OUT sensor 26 becomes on between time t5 and time t5+Δt5, but turns off before time t6, then the medium is shorter than a predetermined length. However, it is usually determined from the output of the IN sensor 24 that the medium is shorter than a predetermined length.

If the OUT sensor 26 becomes on between time t5 and time t5+Δt5, but does not turn off between time t6 and time t6+Δt6, then it is determined that the medium is not properly transported or a plurality of pages are fed in overlapped relation. Times Δt5 and Δt6 are time margins that accommodate variations of transport speed and the length of transport path.

{Normal Printing Operation}

The printing operation of the first embodiment will be described.

Referring to FIG. 3, a controller (CU), not shown, in the printer 11 receives print data and a control command from a host apparatus. Upon receiving the print command, the controller sends a command to the engine controller 30 to start a printing operation. The engine controller 30 causes the low voltage power supply 12 to energize a heater element, not shown, built in the fixing unit 20, and then checks the outputs of temperature sensors, not shown, to determine whether the temperature of the fixing unit 20 has reached a desired fixing temperature. If the temperature of the fixing unit 20 is not within a tolerable range, the heater element continues to be energized until the temperature falls in a required temperature range.

The engine controller 30 drives the developing motors 17BK, 17Y, 17M, and 17C while at the same time sends a command to the high voltage power supply 13, which in turn applies the high voltages to charging units of the print engines for black, yellow, magenta, and cyan. A medium sensor and a medium size sensor, not shown, detect the presence and size of a recording medium S that is held in the paper cassette 18, so that a specified medium is fed to the print engines. The hopping motor 19*a* is rotatable in the forward and rearward directions. Initially, the hopping motor 19*a* rotates in the rearward direction to advance the top page of the recording medium S by a predetermined distance until an entrance sensor, not shown, detects the medium S. Then, the hopping motor 19*a* is rotated in the forward direction, so that the recording medium S is further advanced by a registry roller into the print engines 14BK, 14Y, 14M, and 14C.

When the print medium S reaches a position where printing can take place, the print controller 30 generates timing signals upon which image data is produced from the print data on a page-by-page basis. The print controller 30, then sends the image data of respective colors to the corresponding LED heads on a line-by-line basis, the image data being attended by clock signals. Upon receiving the image data for one line, the LED heads hold the image data of the respective colors. The print controller 30 then sends a print drive command STB to the LED heads 16BK, 16Y, 16M, and 16C. In response to the print drive command, the LED heads 16BK, 16Y, 16M, and 16C illuminate the charged surfaces of the corresponding photoconductive drums 31BK, 31Y, 31M, and 31C on a line-by-line basis.

The developing units 15BK, 15Y, 15M, and 15C have photoconductive drums 31BK, 31Y, 31M, and 31C. The LED heads 16BK, 16Y, 16M, and 16C illuminate the negatively charged surfaces of the photoconductive drums 31BK, 31Y, 31M, and 31C to form corresponding electrostatic latent images formed of dots nearly zero volt. Subsequently, negatively charged toner particles of the respective colors are attracted to the dots of the electrostatic latent images by the Coulomb force to form toner images of the respective colors. Then, the toner images of the respective colors advance to transfer points defined between the respective photoconductive drums 31BK, 31Y, 31M, and 31C and the transfer rollers 27.

Then, the engine controller 30 sends a command to the high voltage power supply 13 to apply a positive transfer high voltage to the transfer rollers 27. The toner images on the photoconductive drums 31BK, 31Y, 31M, and 31C are then transferred onto the recording medium S by the transfer rollers 27. After transfer, the recording medium S is advanced to the fixing unit 20 where a heat roller applies heat to the toner images so that the toner images are fused on the recording medium S. Subsequently, the recording medium S passes an exit sensor, not shown, toward the stacker 23. After the recording medium S passes the exit sensor, the engine controller 30 stops applying voltages to the charging units, developing units, and transfer rollers 27, and stops driving the respective developing motors.

In the first embodiment, when a paper jam is detected at the entrance of the print engines during continuous printing, the aforementioned printing operation is carried out normally for a page of recording medium that has passed the location where the paper jam occurred. When a paper jam is detected at a location other than the entrance of the print engines, the transport and printing operation of the recording medium are stopped immediately.

{Paper Jam During Continuous Printing}

The operation of the printer 11 when a paper jam occurs during continuous printing will be described in detail with reference to FIG. 4.

When continuous printing is initiated, pages of the recording medium S are advanced at intervals corresponding to a nominal printing speed of the printer 11, i.e., the recording medium S is fed every T2 from the paper cassette. It takes a time length T1 when the recording medium S passes the IN sensor 24, WR sensor 25, and OUT sensor 26, respectively. Because the transport path of the recording medium S is long, it takes a time length T3 (T3>T2) for the recording medium S to travel from the IN sensor 24 to the OUT sensor 26.

When continuous printing is initiated, the engine controller 30 of the printer 11 checks the output waveforms of the IN sensor 24, WR sensor 25, and OUT sensor 26 to determine the time lengths T1 and T2. In the conventional image recording apparatus, if any one of the time lengths T1 and T2 is not normal, then the engine controller 30 determines that a paper jam has occurred, and stops the entire operation of the printer 11. However, in the first embodiment, the engine controller 30 checks the outputs of the respective sensors to determine whether the ON/OFF time lengths of the sensors are shorter or longer than their predetermined time lengths, thereby determining whether a paper jam has occurred or not. If the engine controller 30 determines that a paper jam has occurred, the engine controller 30 completes the printing of a page that has passed the IN sensor 24 or the WR sensor 25 before the paper jam occurs, and the page is subsequently discharged to the stacker 23.

In other words, if the leading edge of a following one of two consecutive pages has not reached the print engine 14BK located most upstream of the print engines 14Y, 14M, and 14C, the transportation of the following page is stopped while continuing the printing of the preceding page. An operator opens an upper cover, not shown, to remove the jammed page of the recording medium, and then closes the upper cover. A detector, not shown, detects the closure of the upper cover, thereby allowing the subsequent operation to be performed promptly.

Lets assume that the trailing edge of the preceding one of two consecutive pages has passed the IN sensor 24 and WR sensor 25 and therefore the IN sensor 24 and WR sensor 25 are off. Then, it can be said that the leading edge of a following one of two consecutive pages has not reached the print engine 14BK yet, if, for example, one of the following conditions is satisfied.

(1) The recording medium S is advanced forward by a certain distance from the paper cassette 18, but the IN sensor 24 does not become on (i.e., the leading edge of the recording medium has not passed the IN sensor 24).

(2) The leading edge of the recording medium S is advanced a certain distance past the IN sensor 24, but the WR sensor 25 does not become on (i.e., the leading edge of the recording medium S has not passed the WR sensor 25).

Both the IN sensor 24 and the WR sensor 25 remain turned on if the leading edge of a preceding one of two consecutive pages of the recording medium S is trapped at the most upstream print engine 14BK or at downstream print engine 14Y, 14M, or 14C. In this case, if the printing operation of the preceding one of two consecutive pages is continued, the following one of the two consecutive pages under the print engines 14BK, 14Y, 14M, and 14C will also be advanced, with the result that the jammed condition becomes more serious or complicated. Thus, in order to avoid further trouble, the printing operation for the preceding one of the two consecutive pages is halted, but the paper jam is displayed. Likewise, when the tailing edge of the preceding page has not passed both the IN sensor 24 and the WR sensor 25, the printing operation is not performed but the paper jam is displayed on a display 28 (FIG. 3).

{When Sensors Remain On or Off}

A description will now be given of the operation where the IN sensor 24 or the WR sensor 25 remains on or off for a time period longer than a predetermined time length.

Figure 5:
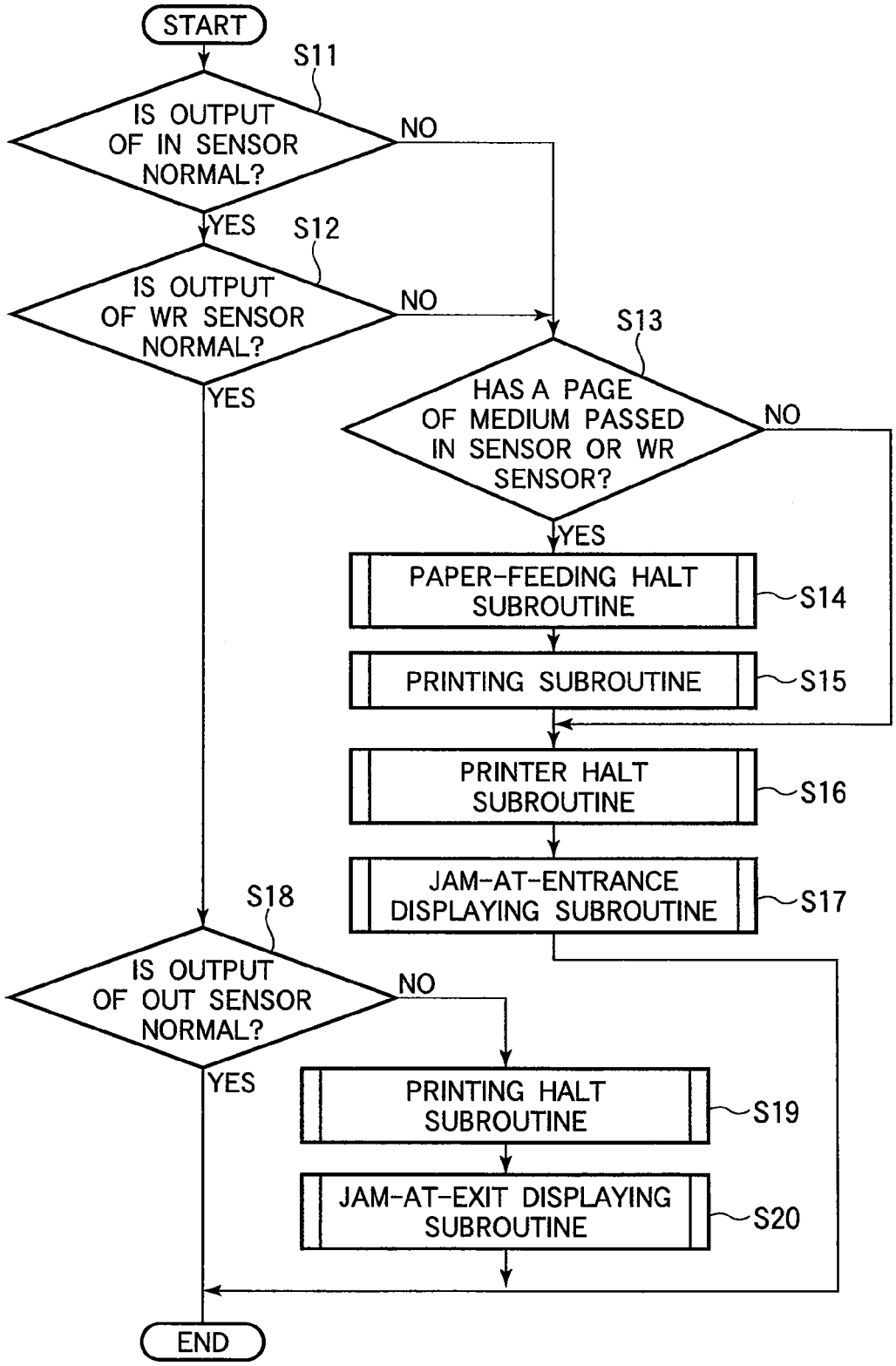
FIG. 5 is a flowchart, illustrating the operation of an image recording apparatus according to the first embodiment.

FIG. 5 is a flowchart, illustrating the operation of an image recording apparatus according to the first embodiment.

When the IN sensor 24 or the WR sensor 25 remains on or off for a time period longer than a predetermined time length, the engine controller 30 checks whether the recording medium S had passed the IN sensor 24 or WR sensor 25. If the recording medium has passed the IN sensor 24 or WR sensor 25 before a paper jam occurs, the engine controller 30 continues to print on that page but stops feeding of subsequent pages of recording medium into the entrance of the print engines 14BK, 14Y, 14M, and 14C. Then, the non-jammed page passes through the print engines 14Bk, 14Y, 14N, and 14C so that printing is performed on the non-jammed page normally and the printed page is discharged. Thereafter, the print controller 30 causes the printer 11 to stop the entire operation and indicates a jammed condition to the user.

Since the jammed page is left near the entrance of the print engines, it is displayed that the jam has occurred at the entrance. In this manner, a paper jam is indicated as occurring at a specific location so that the user can identify a location where the paper jam occurred. If the recording medium has not passed the IN sensor 24 or WR sensor 25 before a paper jam occurs, the paper jam must also be at the entrance. Thus, the print controller 30 causes the printer 11 to stop the operation and the paper jam is indicated as occurring at the entrance. An abnormal condition detected by the OUT sensor 26 is handled just as in the conventional apparatus and the description thereof is omitted.

The flowchart of FIG. 5 will be described on a step-by-step basis.

Step S11: A check is made to determine whether the output waveform of the IN sensor 24 is normal, i.e., the waveform rises and falls within normal time ranges. If the waveform is normal, then the program proceeds to step S12; if abnormal, the program proceeds to step S13.

Step S12: A check is made to determine whether the output waveform of the WR sensor 25 is normal, i.e., the waveform rises and falls within normal time ranges. If the waveform is normal, then the program proceeds to step S18; if abnormal, the program proceeds to step S13.

Step S13: A check is made to determine whether a page of recording medium has passed the IN sensor 24 and/or the WR sensor 25. If a page of the recording medium has passed, then the program proceeds to step S14; if no page has passed, the program proceeds to step S16.

Step S14: A paper-feeding halt subroutine is executed.

Step S15: A printing subroutine is executed.

Step S16: A printer halt subroutine is executed.

Step S17: A jam-at-entrance displaying subroutine is executed.

Step S18: A check is made to determine whether the output waveform of the OUT sensor 26 is normal, i.e., the waveform rises and falls within normal time ranges. If normal, the program ends; if abnormal, the program proceeds to step S19.

Step S19: A printing halt subroutine is executed.

Step S20: A jam-at-exit displaying subroutine is executed.

Because printing is continued for the preceding one of two consecutive pages, it is not necessary to disassemble the developing units 15BK, 15Y, 15M, and 15C one by one in order to remove the jammed recording medium whose printing is not completed yet.

Second Embodiment

A second embodiment addresses a paper jam that occurs near the exit of the apparatus. When continuous printing is being performed, pages of the recording medium are advanced in succession. For example, a following page of two consecutive pages may have entered the print engine 31M for cyan when the trailing edge of a preceding one of two consecutive pages passes. When a paper jam occurs near the exit during continuous printing, the operator opens the upper cover, not shown. Then, the operator removes the crumpled jammed preceding page. After the operator has removed the preceding page near the exit, he closes the upper cover. Upon detecting the closure of the upper cover, the fixing unit 20 is energized to a normal printing temperature TN in response to the closure of the upper cover. Then, the engine controller 30 drives the developing units 15BK, 15Y, 15M, and 15C and the belt motor 21*a* to discharge the following page that is still under the developing units.

{Operation}

The operation of the image recording apparatus of the aforementioned configuration will be described.

Figure 6:
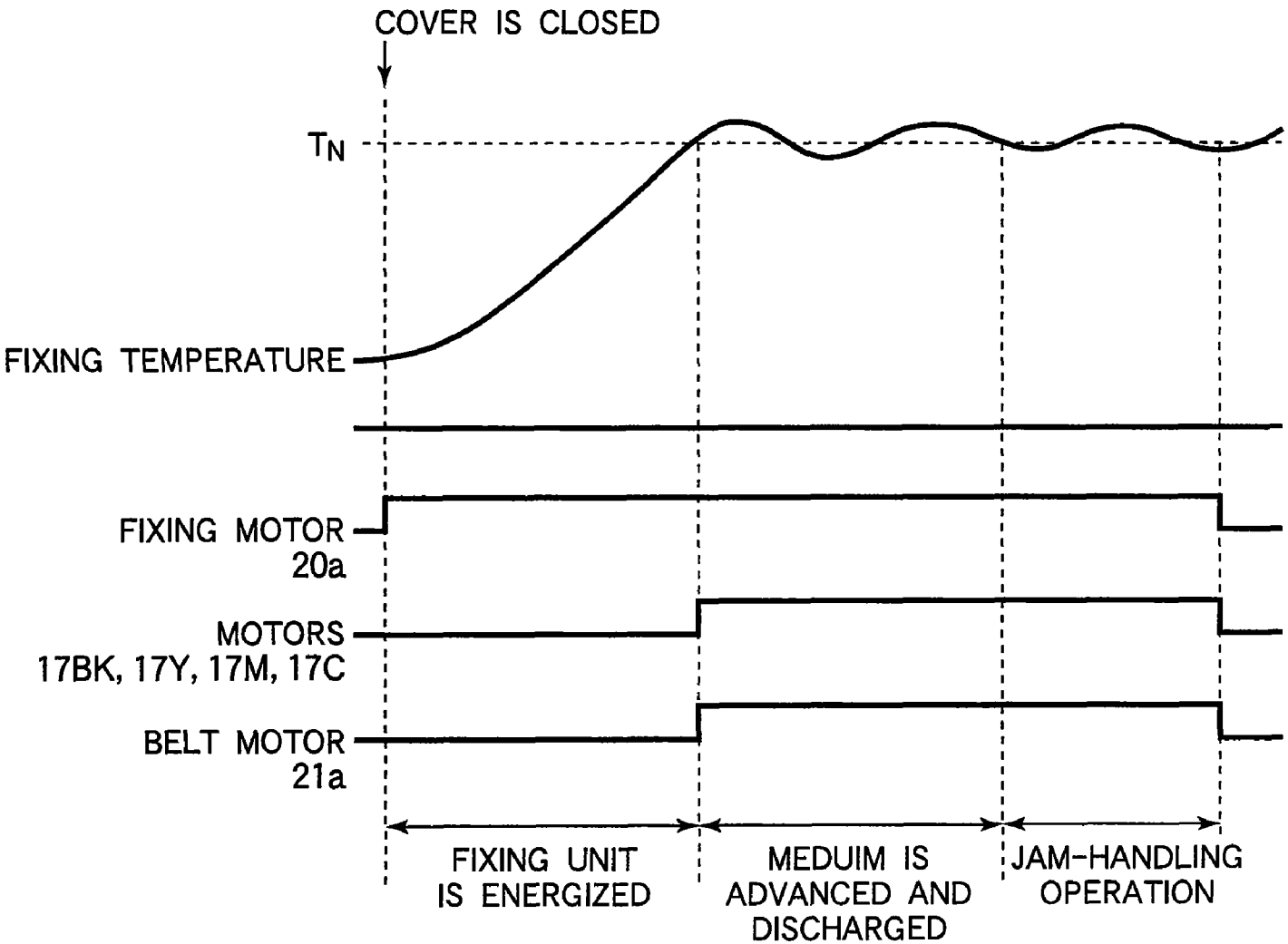
FIG. 6 is a timing chart, illustrating the operation of an image recording apparatus according to a second embodiment.

FIG. 6 is a timing chart, illustrating the operation of an image recording apparatus according to the second embodiment.

Referring to FIG. 6, upon detecting the closure of the upper cover of the image recording apparatus after the jammed page is removed, the temperature of a heat roller of the fixing unit 20 is increased toward the normal printing temperature TN. At the same time, the fixing motor 20*a* is driven into rotation so that the temperature of the heat roller is uniform over its entire surface.

As soon as the temperature of the heat roller reaches the normal printing temperature TN, the engine controller 30 drives the developing motors 17BK, 17Y, 17M, and 17C and the belt motor 21*a*. The engine controller 30 also controls the high voltage power supply 13 just as in the normal printing operation to discharge the recording medium S left under the developing units 15BK, 15Y, 15M, and 15C to the stacker 23.

The time required for the jammed recording medium to be discharged can be short because a page of the recording medium S remaining under the developing units 15BK, 15Y, 15M, and 15C is discharged promptly. After discharging the jammed recording medium, a post discharge operation may be performed as required.

In the second embodiment, when a paper jam occurs near the exit, a page of the jammed recording medium S that is still under the developing units 15BK, 15Y, 15M, and 15C can be discharged without the need for the operator to access the recording medium. A paper jam is less frequent at the exit than at the entrance. The second embodiment is capable of performing a jam-handling operation quickly, and therefore completes the jam-handling operation reliably. The jam-handling operation includes a cleaning operation in which the toner deposited on the charging roller and photoconductive drums is removed and collected to set the printer ready for next printing, and an operation in which the printer online is reset online.

The recording medium S is fed to the fixing unit 20 only when the fixing unit 20 reaches the normal printing temperature TN of the fixing unit 20 and becomes ready for a normal fixing operation. For this reason, the recording medium S having a toner image thereon will not tack to the roller in the fixing unit 20.

Third Embodiment

Figure 7:
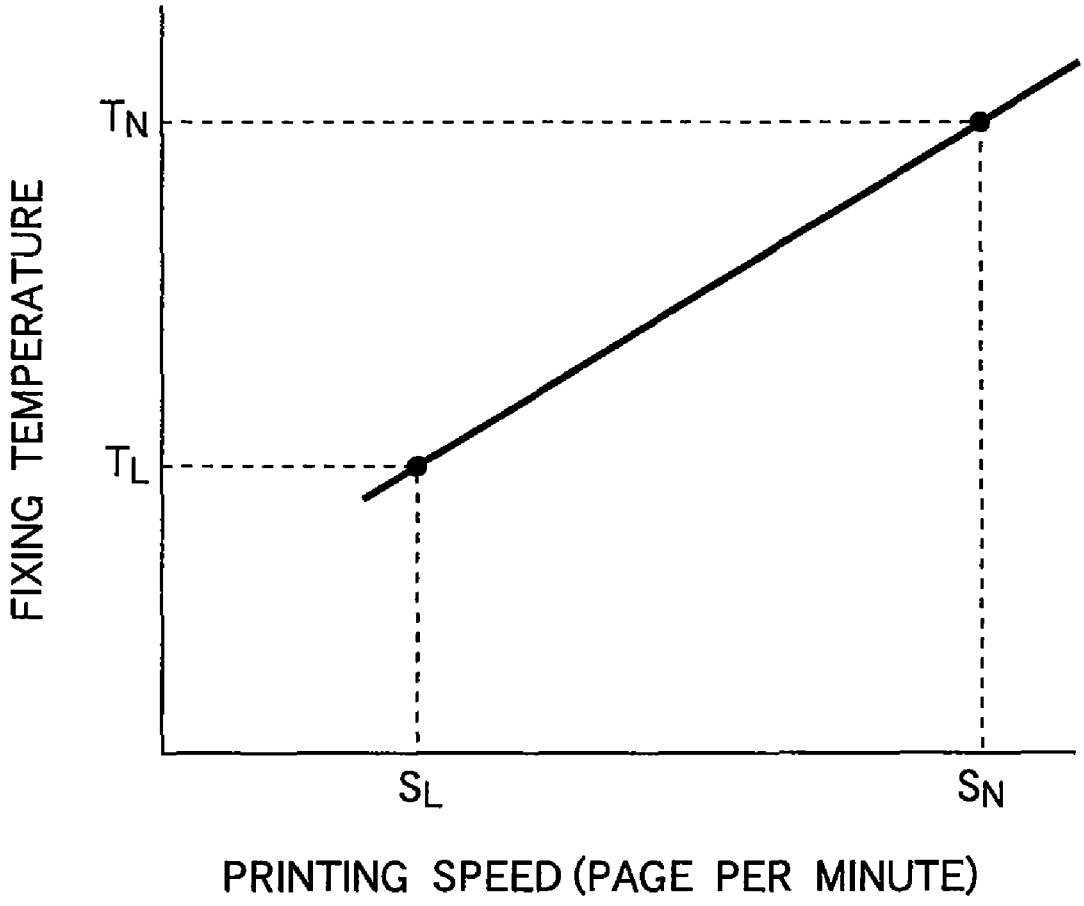
FIG. 7 illustrates the relationship between the printing speed and the fixing temperature according to a third embodiment.

FIG. 7 illustrates the relationship between the printing speed and the fixing temperature according to a third embodiment.

In the second embodiment, it takes some time to heat the fixing unit 20 to the normal printing temperature TN, and therefore takes a long time to discharge a jammed recording medium. The third embodiment allows discharging of the printed recording medium S more quickly than the second embodiment.

Referring to FIG. 7, the printing speed is proportional to the fixing temperature. Thus, the normal printing speed SN of the printer 11 corresponds to the normal printing temperature TN. The lowest printing speed SL corresponds to the lowest temperature TL lower than the normal printing temperature TN.

If the temperature of the fixing unit 20 is lower than TL when the upper cover is closed after removing the jammed paper, the temperature of the fixing unit 20 is increased. As soon as the temperature of the fixing unit 20 reaches TL, the developing motors 17BK, 17Y, 17M, and 17C, fixing motor 20*a*, and belt motor 21*a* can be driven into rotation at the printing speed SL, thereby discharging the recording medium as quickly as possible.

Just as in the second embodiment, the third embodiment eliminates the need for the operator to access the jammed recording medium S left under the developing units 15BK, 15Y, 15M, and 15C, and completes the discharge of the jammed recording medium more quickly than the second embodiment.

Fourth Embodiment

Figure 8:
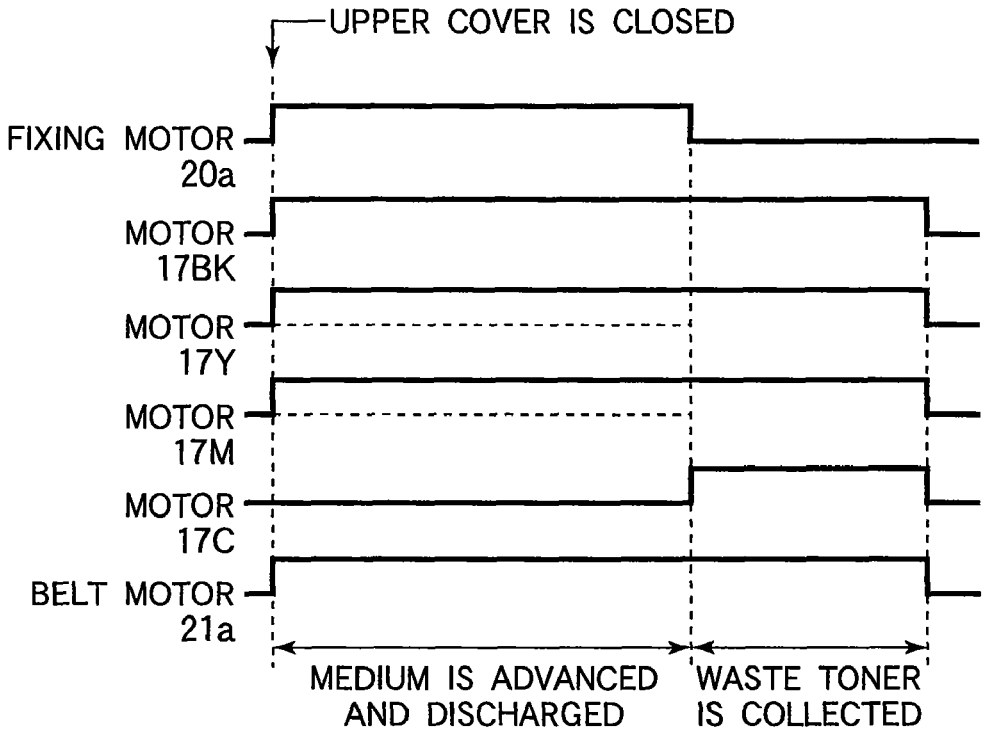
FIG. 8 is a timing chart, illustrating the operation of the image recording apparatus according to a fourth embodiment.

FIG. 8 is a timing chart, illustrating the operation of the image recording apparatus according to a fourth embodiment. The fourth embodiment addresses a paper jam in which more than one page is fed in overlapped relation into the print engines and a paper jam in which a following one of two consecutive pages becomes jammed while a preceding one of the two pages is being normally printed.

The fourth embodiment is characterized in that the developing motor of at least one developing unit located downstream of the other developing units is stopped, and the photoconductive drum of the stopped developing unit is used to scrape the toner off the recording medium S.

Upon closing the upper cover after detecting a paper jam, the developing motors 17BK, 17Y, 17M, and 17C, fixing motor 20*a*, and belt motor 21 a are driven while maintaining the developing motor 17C at rest, thereby discharging the jammed recording medium S just as in the second embodiment.

Referring to FIG. 8, alternatively, the developing motors 17Y and 17M may be driven as shown in solid lines, or may be at rest as shown in dotted lines.

Thus, the transfer belt 21 is driven to run with the recording medium S placed thereon. When the recording medium S reaches a position where the recording medium S is brought into contact with the photoconductive drum 31C, the non-fused toner on the recording medium S is scraped off the recording medium S by the photoconductive drum 31C. Then, the recording medium S passes through the fixing unit 20 to be subsequently discharged. If the developing motors 17Y and 17M are stopped, the non-fused toner on the recording medium is scraped off the recording medium by the photoconductive drums 31Y and 31M.

Because non-fused toner on the recording medium is scraped off the recording medium S, the fourth embodiment eliminates a fixing process in which the temperature of the fixing unit 20 requires to be elevated. Thus, there is no chance of the recording medium of tacking to the heat roller in the fixing unit 20.

After the recording medium S has been discharged, the developing motors 17BK, 17Y, 17M, and 17C are rotated so that the toner is attracted to the photoconductive drums 31C, 31M, and 31Y and collected into a waste toner box 22.

Fifth Embodiment

Figure 9:
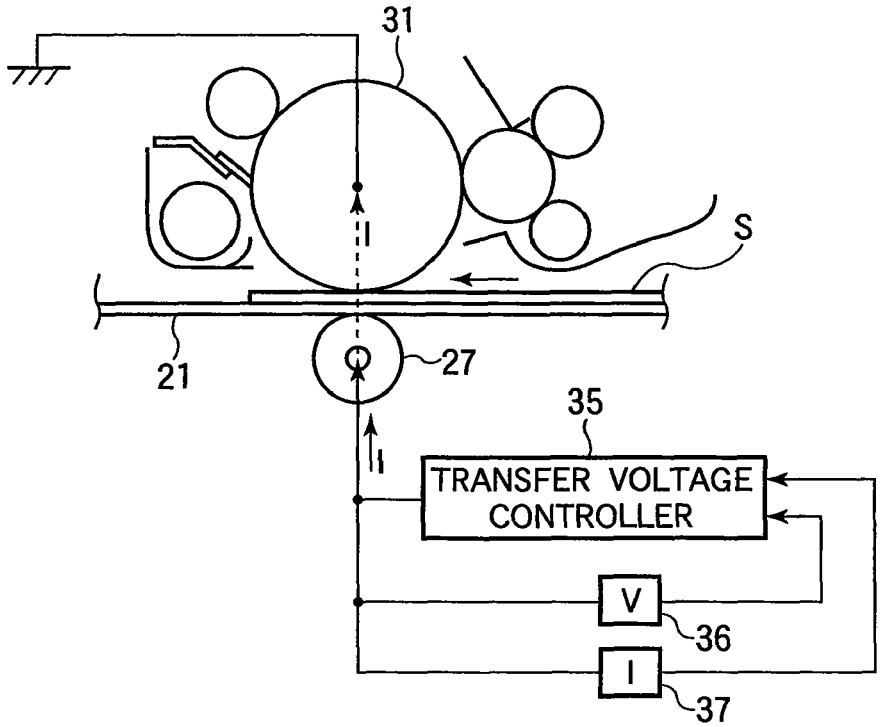
FIG. 9 is a block diagram of a high voltage circuit according to a fifth embodiment.

FIG. 9 is a block diagram of a high voltage circuit according to a fifth embodiment.

Figure 10:
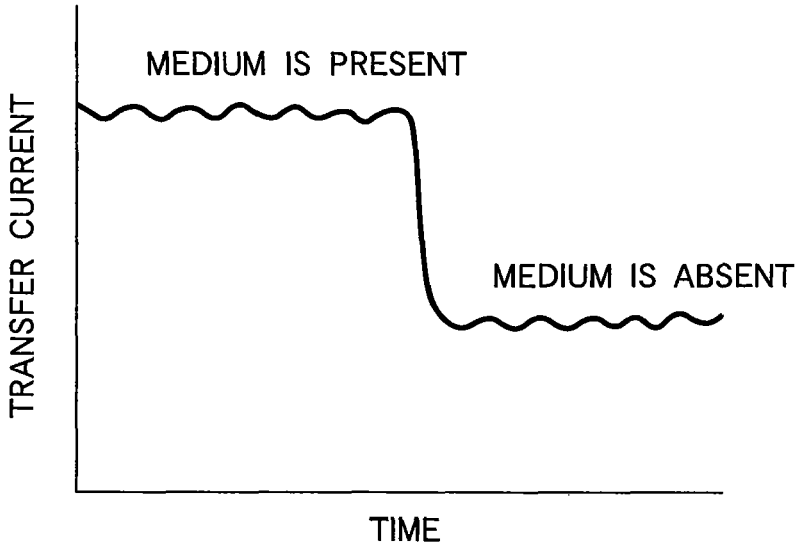
FIG. 10 is a timing chart, illustrating changes in transfer current according to the fifth embodiment.

FIG. 10 is a timing chart, illustrating changes in transfer current according to the fifth embodiment.

The toner can be scraped from the recording medium S just as described in the fourth embodiment. The cyan photoconductive drum 13C may come to rest upon occurrence of a paper jam, before the recording medium S enters between the photoconductive drum 31C and the transfer roller 27. Then, the recording medium S cannot smoothly enter between the photoconductive drum 31C and the transfer roller 27.

Therefore, the developing motor 17C is first driven to rotate the photoconductive drum 31C, so that the leading edge of the recording medium S is smoothly fed between the photoconductive drum 31C and the transfer roller 27. When the leading edge of the recording medium S has entered between the photoconductive drum 31C and the transfer roller 27, the photoconductive drum 31C is stopped but the transfer belt 21 continues to run so that the photoconductive drum 31C scrapes the toner off the recording medium S.

As shown in FIG. 9, the transfer voltage controller 35 monitors the transfer current I when the high voltage power supply 13 supplies a voltage to the transfer roller 27. A voltage detector 36 detects the high voltage and a current detector 37 detects the transfer current I through the transfer point.

As shown in FIG. 10, the transfer current I changes depending on whether the recording medium S is present at the transfer point or not. In other words, if the recording medium S is present between the photoconductive drum 31 and the transfer roller 27, the impedance of the recording medium S causes the transfer current I to decrease. Thus, monitoring the current I allows detection of the presence and absence of the recording medium.

In other words, the feeding of the leading edge of the recording medium S between the photoconductive drum 31C and the transfer roller 27 can be detected from a decrease in transfer current I. Therefore, when the transfer current I decreases, the developing motor 17C for the cyan developing unit is stopped.

Figure 11:
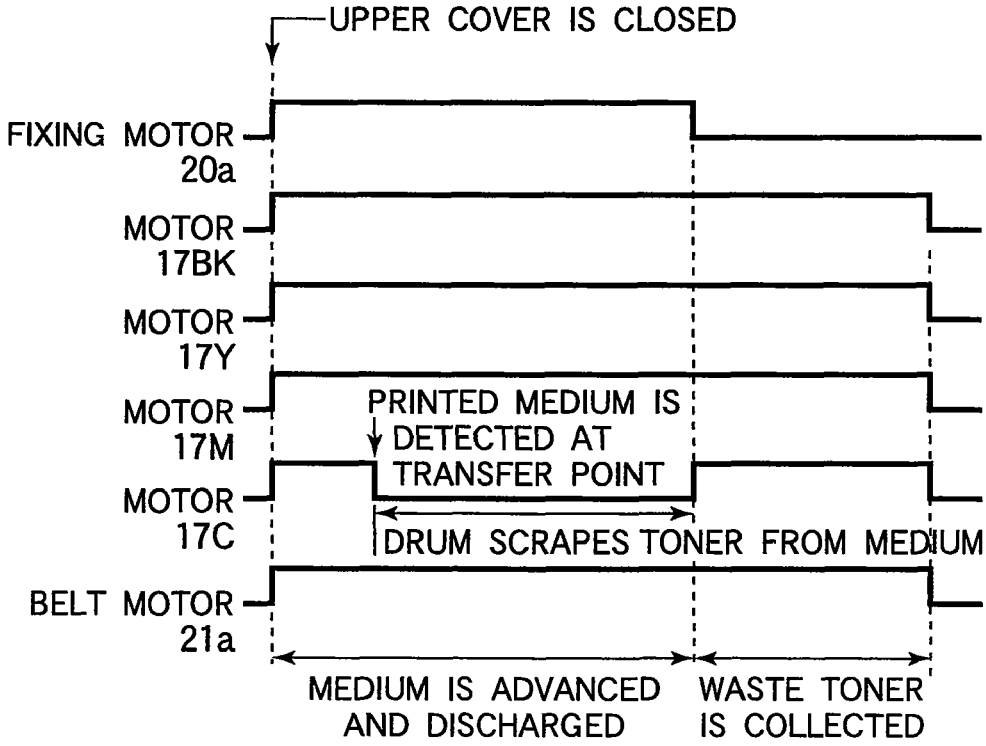
FIG. 11 is a timing chart, illustrating the operation of the image recording apparatus according to the fifth embodiment.

FIG. 11 is a timing chart, illustrating the operation of the image recording apparatus according to the fifth embodiment. As soon as the leading edge of the recording medium S has entered between the photoconductive drum 31C and the transfer roller 27, the motor 17C for the photoconductive drum 31C is stopped. Then, the stationary photoconductive drum 31C scrapes the toner from the recording medium S as the transfer belt 21 runs. Thus, there is no need for increasing the temperature of the fixing unit 20 and nor is there a chance of the recording medium S of tacking to the heat roller. Then, the waste toner is then collected just as in the fourth embodiment. As described above, because the photoconductive drum 31C is still rotated when a paper jam occurs, the leading end of the recording medium S can be fed smoothly into the transfer point defined between the photoconductive drum 31C and the transfer roller 27 smoothly.

Sixth Embodiment

Figure 12:
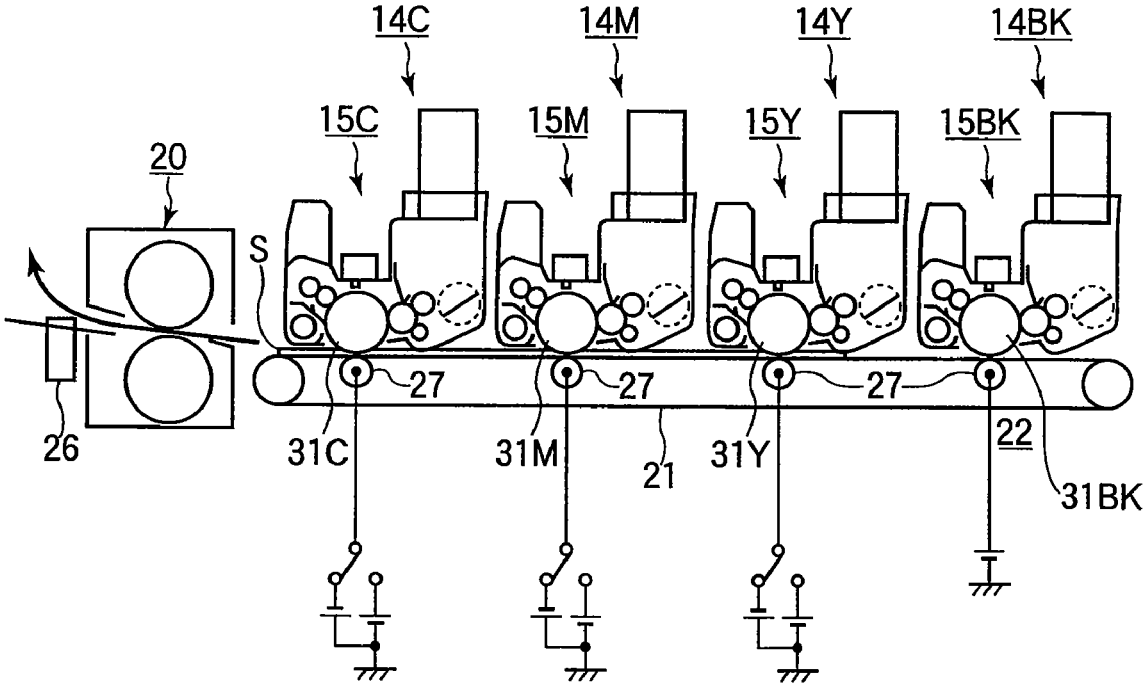
FIG. 12 is a schematic diagram, illustrating the print engines of an image recording apparatus according to a sixth embodiment.

FIG. 12 is a schematic diagram, illustrating the print engines of an image recording apparatus according to the sixth embodiment.

Figure 13:
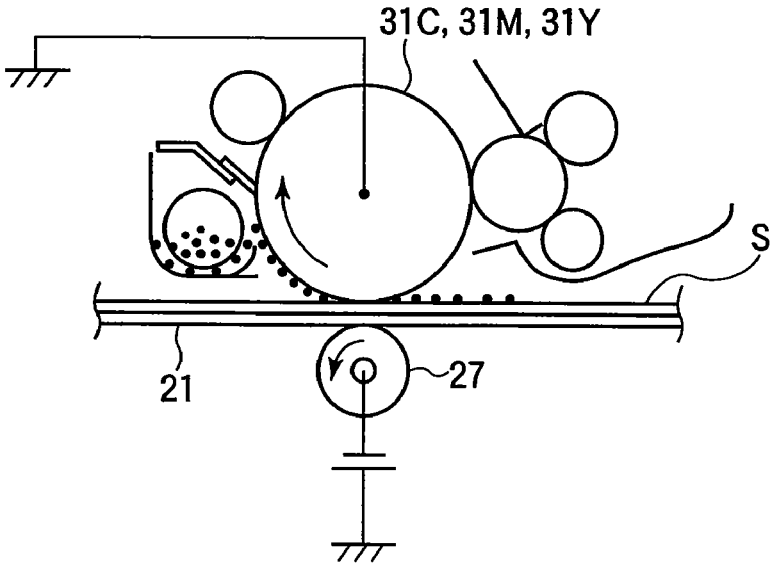
FIG. 13 illustrates a waste toner collecting operation according to the sixth embodiment.

FIG. 13 illustrates a waste toner collecting operation according to the sixth embodiment.

Figure 14:
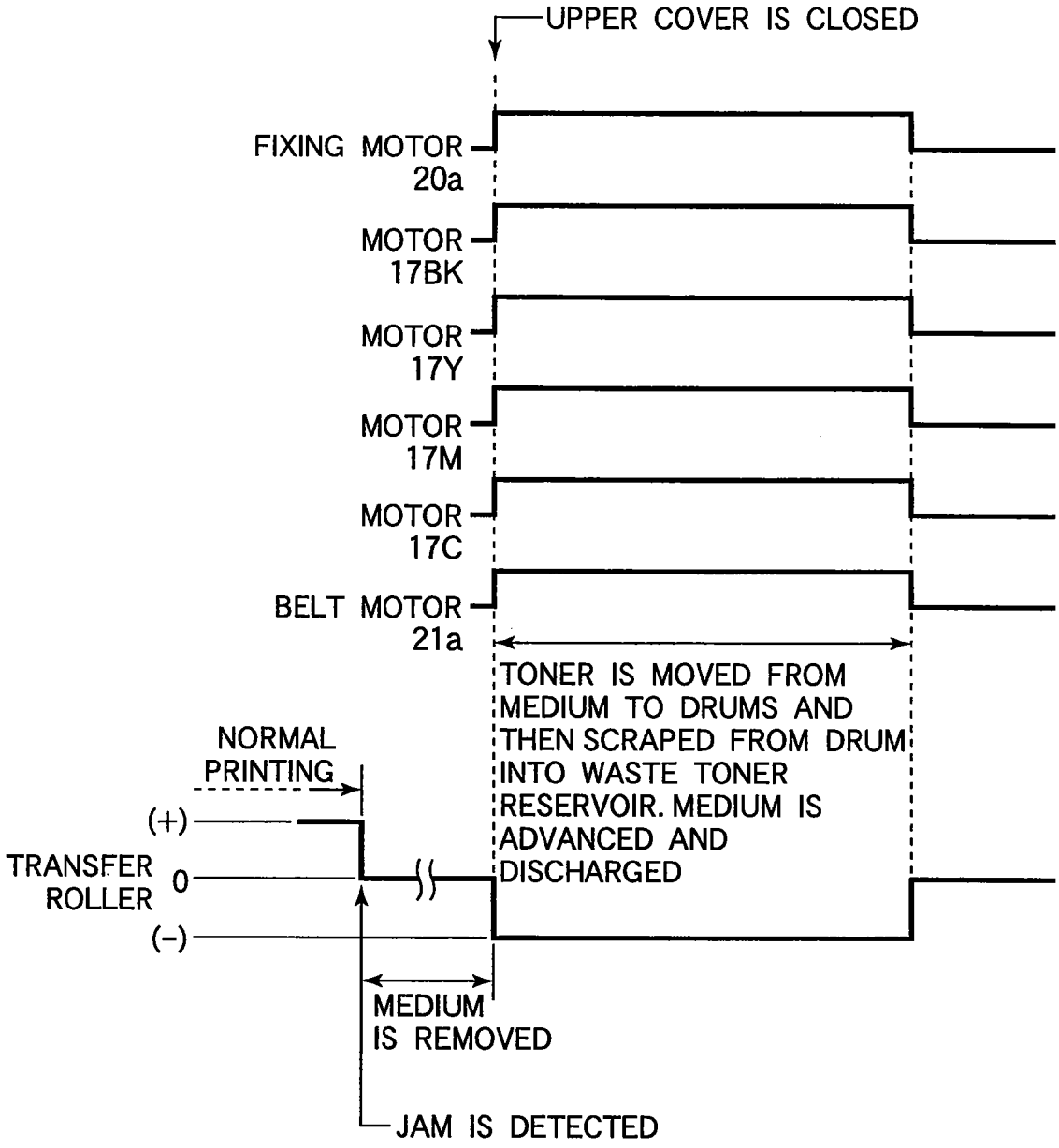
FIG. 14 is a timing chart, illustrating the operation of the sixth embodiment.
Figure 15:
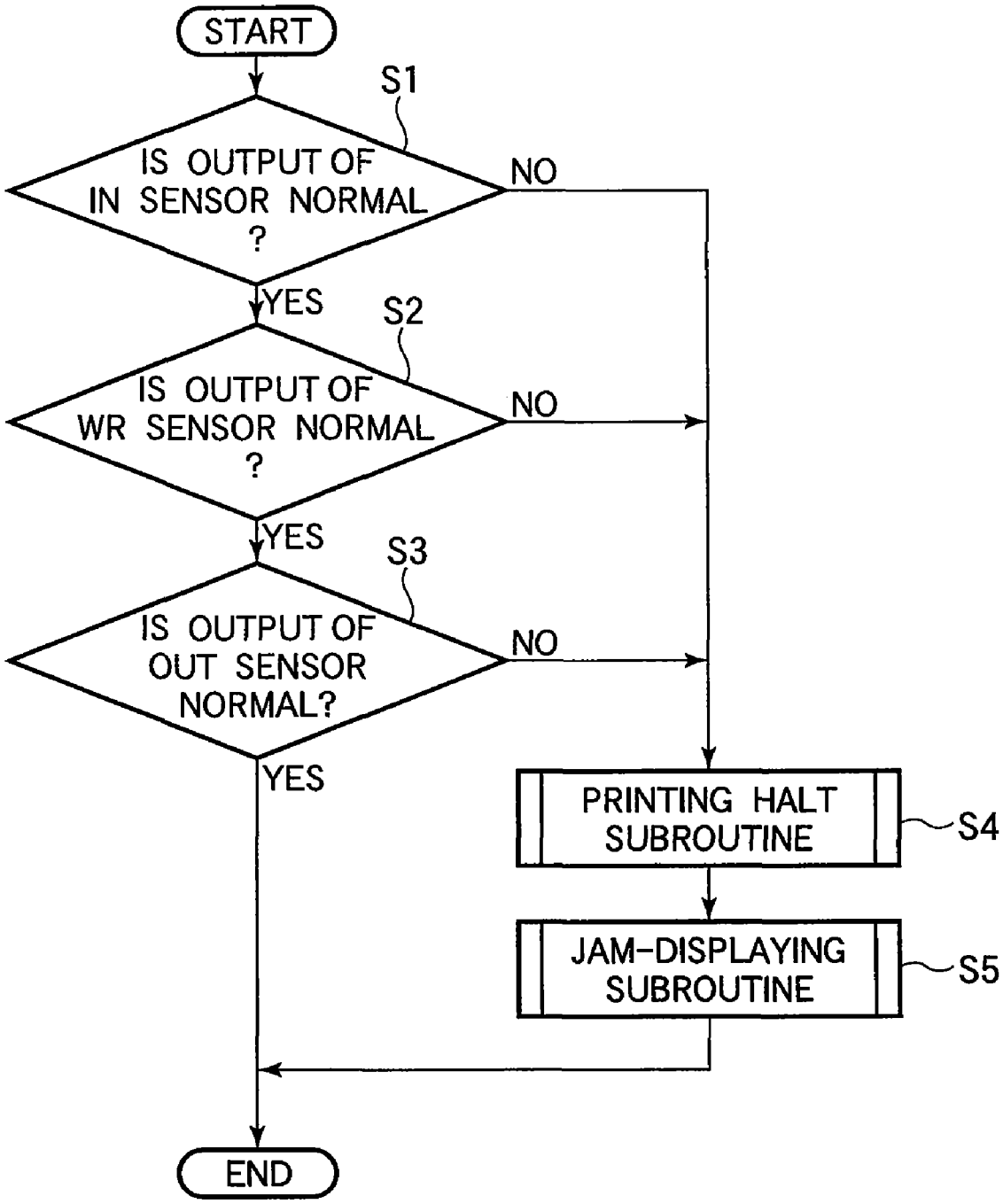
FIG. 15 is a flowchart, illustrating the operation of the conventional image recording apparatus.

FIG. 14 is a timing chart, illustrating the operation of the sixth embodiment.

The sixth embodiment eliminates a waste toner collecting operation (FIGS. 8 and 11) that would otherwise be required after discharging the recording medium S.

The sixth embodiment is characterized in that the transfer rollers of engines 14C, 14M, and 14Y downstream of the print engine 14BK receive a positive transfer voltage during normal printing and a negative transfer voltage during a toner collecting operation. Because the toner is negatively charged normally, the transfer rollers 27 receive a positive voltage during a printing operation, thereby attracting the toner from the photoconductive drums 31C, 31M, 31Y to the recording medium S. The transfer rollers 27 receive a negative voltage during the medium discharging operation, thereby attracting the toner from the recording medium S to the photoconductive drums 31C, 31M, and 31Y.

As shown in FIG. 13, the toner transferred onto the photoconductive drums 31C, 31M, and 31 Y is brought to cleaning blades which in turn scrape the toner off the corresponding photoconductive drums 31C, 31M, and 31Y. The toner is then collected into a waste toner reservoir, not shown, disposed downstream of the transfer point with respect to the rotation of the photoconductive drum. The recording medium S from which the toner has been removed does not tack to the roller, so that the recording medium S is discharged from the apparatus without difficulty.

In the sixth embodiment, the operator is freed from accessing the recording medium S trapped under the developing units 15BK, 15C, 15M, and 15Y. The non-fused toner is moved from the recording medium S to the photoconductive drums before the recording medium S enters the fixing unit 20, eliminating the need for increasing the temperature of the fixing unit 20.

While the sixth embodiment has been described with respect to a case where the photoconductive drums attract non-fused toner from the recording medium, blades or rollers for removing the toner may be used in place of the photoconductive drums 31C, 31M, and 31Y.

While the sixth embodiment has been described with respect to a tandem-type electrophotographic color printer, the invention may also be applied to other types of apparatus such as a monochrome printer and a copying machine.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image recording apparatus, comprising:

a print engine that transfers a toner image onto a recording medium;

a fixing unit that fixes the toner image transferred onto the recording medium by said print engine;

a medium sensor that outputs a detection signal when a recording medium passes said medium sensor; and a controller that determines from the detection signal whether an abnormal transportation of the recording medium has occurred or not, wherein when continuous printing is performed for at least two consecutive pages, if a preceding page one of the consecutive pages is abnormally transported and said controller determines from the detection signal that a following page of the consecutive pages remains in said print engine after the preceding page has been removed from the image recording apparatus, then said controller controls said fixing unit to a fixing temperature lower than a fixing temperature for a normal printing operation and subsequently allows the following page to pass through said fixing unit at a speed lower than a speed for the normal printing operation to be discharged from the image recording apparatus.

2. The image recording apparatus according to claim 1, further comprising a medium transporting member that transports the recording medium placed thereon, wherein said print engine is one of a plurality of print engines aligned along said medium transporting member in a direction in which said medium transporting member runs with the recording medium (S) placed thereon.

3. The image recording apparatus according to claim 1, wherein said controller receives the detection signal from a medium sensor located downstream of said print engine with respect to the transport direction.

4. The image recording apparatus according to claim 1, wherein when said controller performs control of the temperature and discharging of the recording medium in response to closure of a cover of the image recording apparatus.

* * * * *